US011849269B2

(12) United States Patent
Uemoto et al.

(10) Patent No.: US 11,849,269 B2
(45) Date of Patent: Dec. 19, 2023

(54) LOUDSPEAKER UNIT, ELECTRONIC DEVICE, AND MOBILE BODY APPARATUS

(71) Applicant: Panasonic Intellectual Property Management Co., Ltd., Osaka (JP)

(72) Inventors: Ryouichi Uemoto, Osaka (JP); Goro Tsuchiya, Aichi (JP); Hidetoshi Asada, Osaka (JP); Takayuki Dan, Aichi (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 147 days.

(21) Appl. No.: 17/501,359

(22) Filed: Oct. 14, 2021

(65) Prior Publication Data

US 2022/0038801 A1 Feb. 3, 2022

Related U.S. Application Data

(63) Continuation of application No. PCT/JP2020/016276, filed on Apr. 13, 2020.

(30) Foreign Application Priority Data

Apr. 19, 2019 (JP) ..... 2019-080410

(51) Int. Cl.
*H04R 1/02* (2006.01)
*H04R 9/02* (2006.01)

(52) U.S. Cl.
CPC ..... *H04R 1/025* (2013.01); *H04R 1/021* (2013.01); *H04R 9/025* (2013.01); *H04R 2201/02* (2013.01)

(58) Field of Classification Search
CPC ..... H04R 1/025; H04R 1/021; H04R 9/025; H04R 2201/02

(Continued)

(56) References Cited

U.S. PATENT DOCUMENTS

2014/0093119 A1 4/2014 Kagawa et al.
2019/0335259 A1 10/2019 Uemoto et al.

FOREIGN PATENT DOCUMENTS

JP 2018-014693 A 1/2018
WO 2013/161214 A1 10/2013

OTHER PUBLICATIONS

Japan Patent Office (JPO) Office Action (including English Language Translation), dated Dec. 20, 2022, for the corresponding Japanese Patent Application No. 2019-080410.

(Continued)

*Primary Examiner* — Sean H Nguyen
(74) *Attorney, Agent, or Firm* — GREENBLUM & BERNSTEIN, P.L.C.

(57) ABSTRACT

A loudspeaker unit includes a frame that supports a diaphragm and a magnetic circuit. The frame includes: a first support supporting a perimeter of the diaphragm; a pedestal extending outwardly from a perimeter of the first support; fastening portions provided in positions on the pedestal that surround the perimeter of the first support; and reinforcements disposed in regions of the pedestal between the fastening portions, and fixed to the first support and the pedestal. The reinforcements include: a first plate portion that is a plate-shaped portion disposed in front of the pedestal to face the pedestal, and has a bent shape that protrudes in the forward direction; and a second plate portion that is a plate-shaped portion disposed in front of the pedestal to face the pedestal and the first plate portion, and has a bent shape that protrudes in a rearward direction.

11 Claims, 6 Drawing Sheets

(58) Field of Classification Search
USPC ..... 381/386
See application file for complete search history.

(56) References Cited

OTHER PUBLICATIONS

International Search Report (including English Language Translation), dated Jul. 14, 2020 by the Japan Patent Office (JPO), in International Patent Application No. PCT/JP2020/016276.

LOUDSPEAKER UNIT, ELECTRONIC DEVICE, AND MOBILE BODY APPARATUS

CROSS REFERENCE TO RELATED APPLICATIONS

This is a continuation application of PCT International Application No. PCT/JP2020/016276 filed on Apr. 13, 2020, designating the United States of America, which is based on and claims priority of Japanese Patent Application No. 2019-080410 filed on Apr. 19, 2019.

FIELD

The present disclosure relates to a loudspeaker unit, an electronic device, and a mobile body apparatus.

BACKGROUND

A conventional loudspeaker in which a frame supporting a diaphragm is reinforced by a reinforcement rib is disclosed (Patent Literature (PTL) 1).

CITATION LIST

Patent Literature

PTL 1: WO 2013/161214

SUMMARY

However, the loudspeaker according to PTL 1 can be improved upon.

In view of this, the present disclosure provides a loudspeaker unit and the like capable of improving upon the above related art.

A loudspeaker unit according to an aspect of the present disclosure is a loudspeaker unit including: a frame that supports a diaphragm and a magnetic circuit to allow emission of a sound in a forward direction, wherein the frame includes: a support supporting a perimeter of the diaphragm; a pedestal extending outwardly from a perimeter of the support; a plurality of fastening portions provided in a plurality of positions on the pedestal that surround the perimeter of the support; and a plurality of reinforcements disposed in a plurality of regions of the pedestal between the plurality of fastening portions, and fixed to the support and the pedestal, and the plurality of reinforcements include: a first plate portion that is a plate-shaped portion disposed in front of the pedestal to face the pedestal, and has a bent shape that protrudes in the forward direction; and a second plate portion that is a plate-shaped portion disposed in front of the pedestal to face the pedestal and the first plate portion, and has a bent shape that protrudes in a rearward direction.

The loudspeaker unit according to the present disclosure can achieve sufficient weight reduction while ensuring stiffness of the frame.

BRIEF DESCRIPTION OF DRAWINGS

These and other advantages and features of the present disclosure will become apparent from the following description thereof taken in conjunction with the accompanying drawings that illustrate a specific embodiment of the present disclosure.

Figure 1:
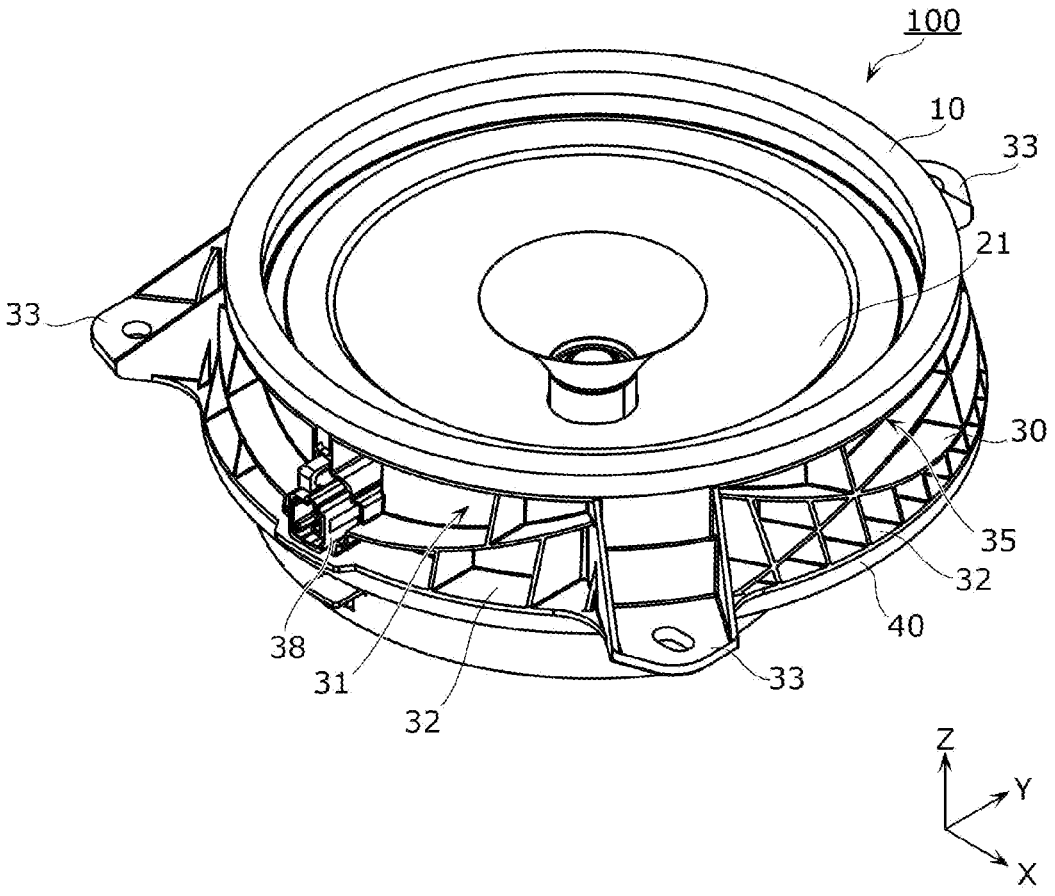
FIG. 1 is a perspective view illustrating an example of an external appearance of a loudspeaker unit according to Embodiment 1.

DESCRIPTION OF EMBODIMENTS (Underlying Knowledge Forming Basis of the Present Disclosure)

Recent years have been a demand for further weight reduction of in-car loudspeaker units to improve fuel efficiency of automobiles. The loudspeaker disclosed in PTL 1 does not achieve sufficient weight reduction.

In view of this, the present disclosure provides a loudspeaker unit which can achieve sufficient weight reduction.

A loudspeaker unit according to an aspect of the present disclosure is a loudspeaker unit including: a frame that supports a diaphragm and a magnetic circuit to allow emission of a sound in a forward direction, wherein the frame includes: a support supporting a perimeter of the diaphragm; a pedestal extending outwardly from a perimeter of the support; a plurality of fastening portions provided in a plurality of positions on the pedestal that surround the perimeter of the support; and a plurality of reinforcements disposed in a plurality of regions of the pedestal between the plurality of fastening portions, and fixed to the support and the pedestal, and the plurality of reinforcements include: a first plate portion that is a plate-shaped portion disposed in front of the pedestal to face the pedestal, and has a bent shape that protrudes in the forward direction; and a second plate portion that is a plate-shaped portion disposed in front of the pedestal to face the pedestal and the first plate portion, and has a bent shape that protrudes in a rearward direction.

According to this, the plurality of reinforcements include the first plate portion which is a plate-shaped portion having a bent shape that protrudes in the forward direction and the second plate portion which is a plate-shaped portion having a bent shape that protrudes in the rearward direction, and thus, it is possible to effectively improve the stiffness of the plurality of regions of the frame between the plurality of fastening portions. This makes it possible to ensure the stiffness necessary for the frame, even when the weight of the frame is sufficiently reduced. Accordingly, it is possible to sufficiently reduce the weight of the loudspeaker unit while ensuring the stiffness of the frame.

The plurality of reinforcements may be exposed in an outward direction of the loudspeaker unit.

Thus, the stiffness of the frame can be improved without complicating the shape of the frame.

The bent shape of at least one of the first plate portion or the second plate portion included in the plurality of reinforcements may be a curved shape.

Thus, the stiffness of the plurality of reinforcements can be improved effectively.

The bent shape of at least one of the first plate portion or the second plate portion included in the plurality of reinforcements may be an angular shape.

Thus, the stiffness of the plurality of reinforcements can be improved effectively.

At least one of the first plate portion or the second plate portion included in the plurality of reinforcements may be disposed across an entire region between two adjacent fastening portions included in the plurality of fastening portions.

Thus, it is possible to effectively improve the stiffness of the frame in the entire region between the two adjacent fastening portions.

An end of the first plate portion included in the plurality of reinforcements in a peripheral direction of the perimeter of the support may be connected to the pedestal.

Thus, the stiffness of the plurality of reinforcements can be improved effectively.

The first plate portion and the second plate portion may intersect one another at two positions.

Thus, it is possible to increase the lengths of portions of the first plate portion and the second plate portion that are fixed to the support. Accordingly, the stiffness of the support can be improved effectively.

The plurality of reinforcements may further include: two third plate portions that are oriented to intersect the support and the pedestal, and that further intersect the first plate portion and the second plate portion at the two positions at which the first plate portion and the second plate portion intersect.

Thus, the stiffness of the support and the pedestal can be improved effectively.

The plurality of reinforcements may further include: a fourth plate portion oriented to intersect the support and the pedestal, and disposed at a substantial center of at least one of the first plate portion or the second plate portion in a peripheral direction of the perimeter of the support.

Thus, the stiffness of the support and the pedestal can be improved effectively.

The support may include a flange that is disposed in front of the first plate portion to face the first plate portion, and extends outwardly from the perimeter of the support, and a portion of the first plate portion may be connected to the flange.

Thus, the stiffness of the flange can be improved effectively.

A portion of the second plate portion may be connected to the pedestal.

Thus, the stiffness of the pedestal can be improved effectively.

Note that these general or specific aspects may be implemented by an electronic device and a mobile body apparatus that include the loudspeaker unit.

The following specifically describes a loudspeaker unit according to an aspect of the present disclosure with reference to the drawings.

Note that each of the embodiments described below illustrates a specific example of the present disclosure. The numerical values, shapes, materials, elements, the arrangement and connection of the elements illustrated in the following embodiments are mere examples, and are not intended to limit the present disclosure. Among the elements in the following embodiments, those not recited in any one of the independent claims representing the most generic concepts are described as optional elements.

Embodiment 1

The following describes a loudspeaker unit according to Embodiment 1 with reference to FIG. 1 through FIG. 5.

Note that in the present embodiment, the direction in which the central axis of the loudspeaker unit extends is referred to as a Z-axis direction, the direction in which a connector is located relative to the central axis is referred to as a Y-axis direction, and the direction orthogonal to the Z-axis direction and the Y-axis direction is referred to as an X-axis direction. In FIG. 1 through FIG. 5, the respective sides pointed by the arrows indicating the X axis, Y axis, and Z axis are referred to as the positive directions of their respective directions, and the directions opposite the respective positive directions are referred to as the negative directions. Note that the central axis of the loudspeaker unit is the central axis of the substantially conical shape of the loudspeaker unit.

[1-1. Configuration of Loudspeaker Unit]

Figure 2:
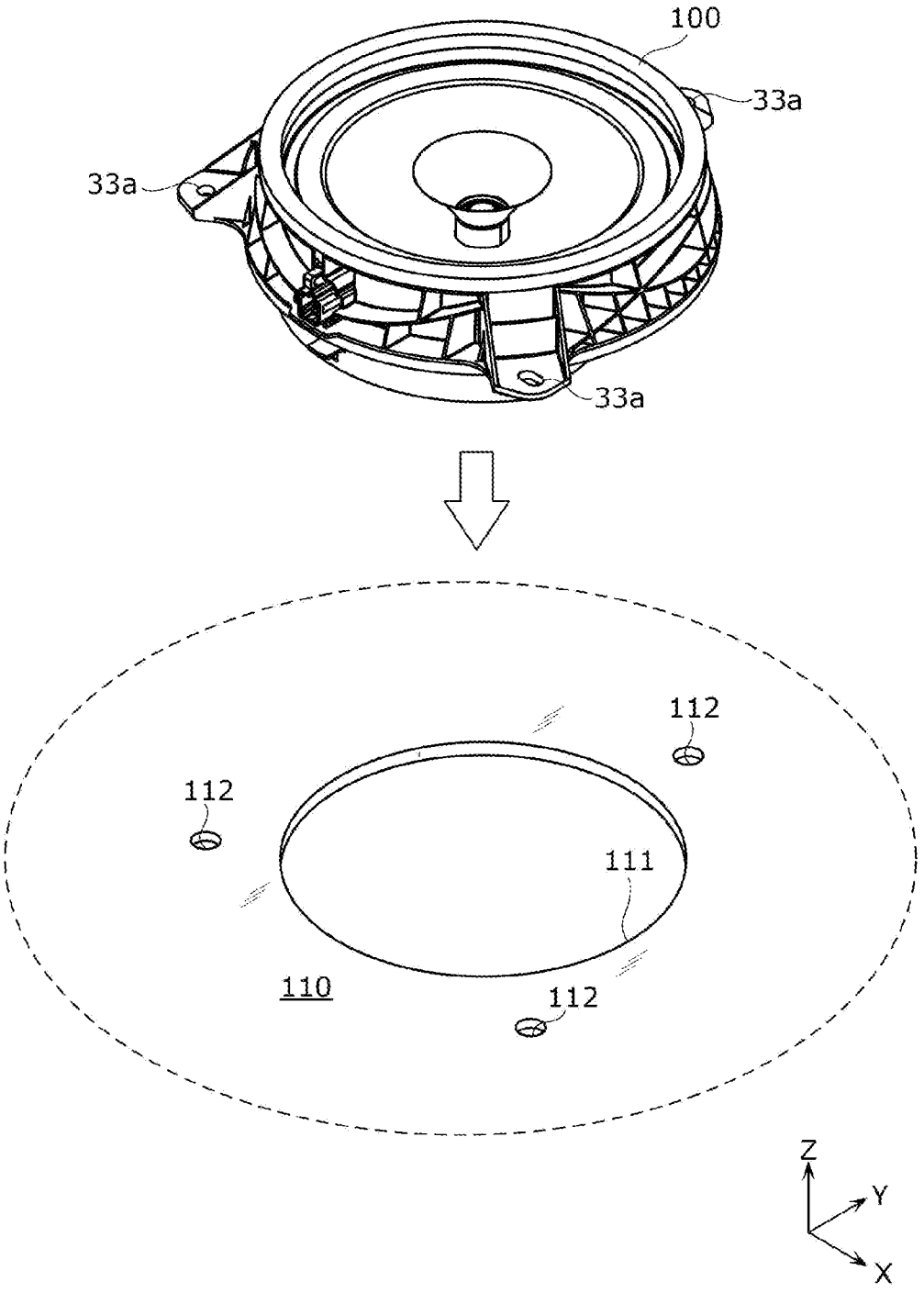
FIG. 2 illustrates an example of fastening of the loudspeaker unit to an external housing.
Figure 3:
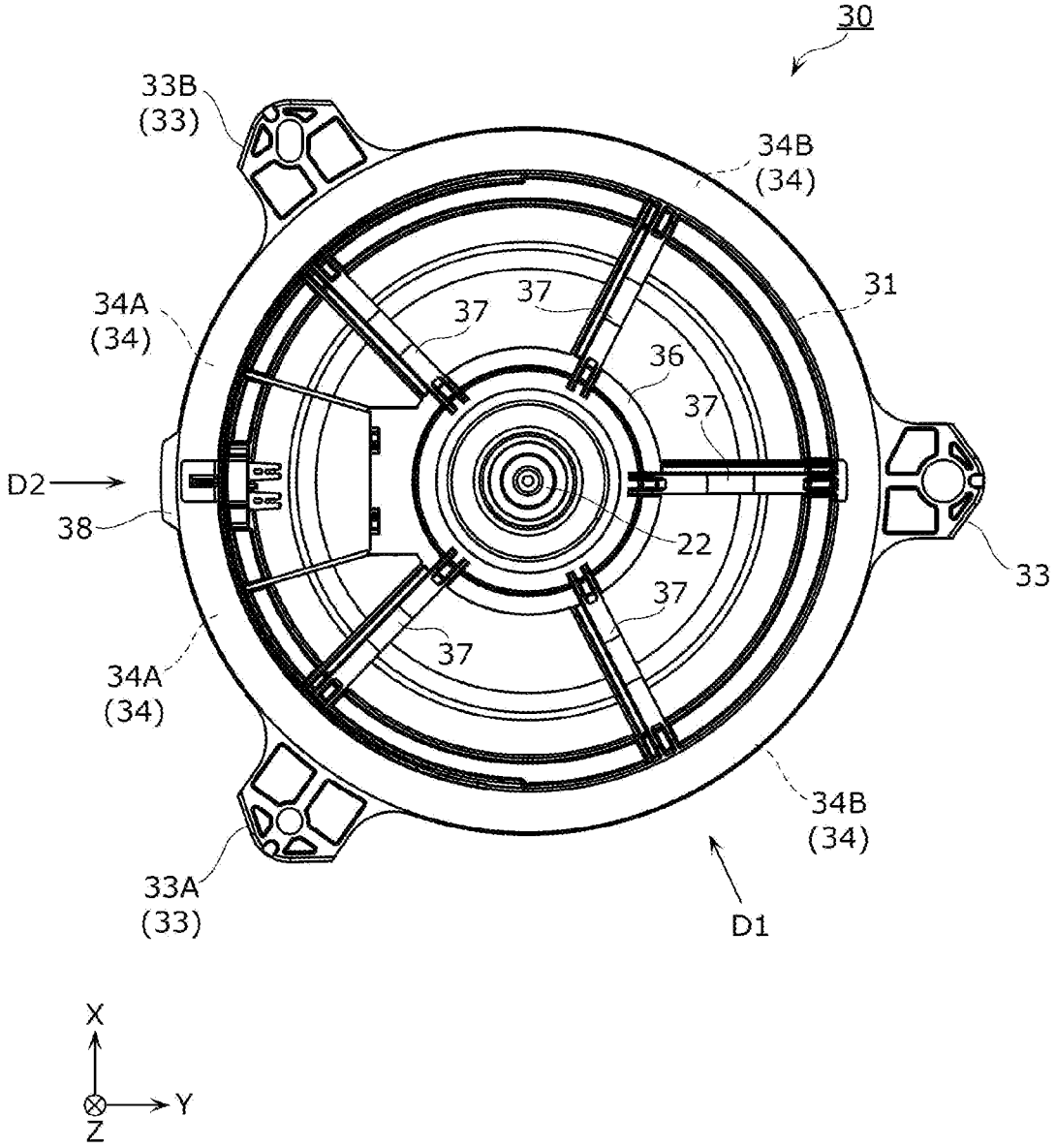
FIG. 3 is a plan view of the loudspeaker unit viewed from the back side.

The following describes a configuration of loudspeaker unit 100 according to Embodiment 1 with reference to FIG. 1 through FIG. 3.

FIG. 1 is a perspective view illustrating an example of an external appearance of the loudspeaker unit according to Embodiment 1. FIG. 2 illustrates an example of fastening of the loudspeaker unit to an external housing. FIG. 3 is a plan view of the loudspeaker unit viewed from the back side.

Loudspeaker unit 100 often includes first elastic component 10 on a side of frame 30 from which loudspeaker unit 100 emits a sound, and second elastic component 40 on the opposite side, in order to improve the air tightness and the water tightness and reduce rattle caused by vibration generated when loudspeaker unit 100 operates.

Loudspeaker unit 100 includes frame 30 that couples diaphragm 21 having a substantially conical shape and magnetic circuit 22 having a substantially circular cylindrical shape. Magnetic circuit 22 includes a magnet, a plate, and a yoke that are not illustrated, and vibrates diaphragm 21 according to an audio signal input to a voice coil that is not illustrated. Magnetic circuit 22 may be inner magnet type, or may be outer magnet type.

Frame 30 is a component that supports diaphragm 21 and magnetic circuit 22 to allow emission of a sound in the forward direction. Frame 30 is an example of the support. As illustrated in FIG. 2, frame 30 is a component for fixing loudspeaker unit 100 to external housing 110 such as a front door of an automobile, by a fastener (not illustrated) fastening a plurality of fastening portions 33 of frame 30 and a plurality of through-holes 112 in external housing 110 to opening portion 111 which is circular and provided in external housing 110. Frame 30 includes resin, for example.

[1-2. Configuration of Frame]

Next, the following describes a detailed configuration of frame 30 with reference to FIG. 1 and FIG. 3.

As illustrated in FIG. 1 and FIG. 3, frame 30 includes first support 31 having a substantially tubular shape, pedestal 32, a plurality of fastening portions 33, and a plurality of reinforcements 34. Frame 30 may further include second support 36, a plurality of connection portions 37, and connector 38. Note that elements 31 through 38 of frame 30 are formed as an integral unit using resin.

First support 31 is a portion which supports diaphragm 21 included in loudspeaker unit 100. Specifically, first support 31 is a substantially cylindrical portion which supports the perimeter of diaphragm 21 disposed inside first support 31. First support 31 has a shape corresponding to the perimeter of diaphragm 21.

Second support 36 is a portion which supports magnetic circuit 22 and a portion of a damper that is a vibration component, which are included in loudspeaker unit 100. Specifically, second support 36 is a component having a substantially cylindrical shape with a closed-bottom and a substantially conical shape. Second support 36 is a portion located on the Z-axis negative side of a portion of loudspeaker unit 100 located in the Z-axis negative direction, and has a shape corresponding to magnetic circuit 22 of loudspeaker unit 100.

As illustrated in FIG. 3, first support 31 and second support 36 are connected by a plurality of connection portions 37 such that second support 36 is located inside first support 31 when viewed in the Z-axis direction. The plurality of connection portions 37 are beam-like portions.

Pedestal 32 is a loop portion which extends outwardly from the perimeter of first support 31 and faces opening portion 111 provided in external housing 110. Pedestal 32 is a plate-shaped portion and sandwiches second elastic component 40 with opening portion 111 to improve the air tightness and the water tightness between pedestal 32 and opening portion 111. Note that opening portion 111 is a portion defining an opening of external housing 110.

Note that frame 30 includes, in the Z-axis positive direction, flange 35 which faces pedestal 32. Flange 35 is a loop portion which is provided at an end portion of first support 31 in the Z-axis positive direction and extends outwardly from the end portion. Flange 35 contacts, via first elastic component 10, an opening portion (not illustrated) provided in an internal housing located on the side of loudspeaker unit 100 from which a sound is emitted. Note that the opening portion not illustrated is a portion defining an opening of the internal housing.

The plurality of fastening portions 33 (three in the present embodiment) are portions provided in a plurality of positions on pedestal 32 that surround the perimeter of first support 31. Specifically, the plurality of fastening portions 33 are portions which extend and protrude outwardly from pedestal 32 (in a direction away from the central axis) and have a thickness greater than the thickness of pedestal 32. The plurality of fastening portions 33 have through-holes 33*a* through which given fasteners pass. Note that given fasteners are, for example, screws, bolts, rivets, or the like. That is to say, loudspeaker unit 100 is fixed at a predetermined position of opening portion 111 by being fastened to opening portion 111 with given fasteners at the plurality of fastening portions 33.

The plurality of fastening portions 33 have plate-shaped protruding portions 33*b* which outwardly protrude from the perimeter of first support 31. Specifically, plate-shaped protruding portions 33*b* are paired portions formed at both ends of one fastening portion 33 in the peripheral direction of the perimeter of first support 31. Protruding portions 33*b* have shapes substantially parallel to the Z-axis direction and the radial direction of the perimeter. Protruding portions 33*b* are continuously formed from the peripheral surface of first support 31 to a surface of pedestal 32 in the Z-axis positive direction. This ensures the strength of the plurality of fastening portions 33, thus reducing deformation of the plurality of fastening portions 33 with respect to pedestal 32.

The plurality of fastening portions 33 are disposed at positions on frame 30 that are spaced apart from one another by 120 degrees around a position corresponding to the central axis of loudspeaker unit 100. Since the total number of fastening portions 33 is three, fastening portions 33 are disposed on the perimeter of first support 31 at equal spaces.

The plurality of reinforcements 34 are disposed in a plurality of regions of pedestal 32 between the plurality of fastening portions 33, and are fixed to the peripheral surface of first support 31 and pedestal 32. The plurality of reinforcements 34 are fixed to a surface of pedestal 32 on a side opposite the opening portion 111 side (i.e., the surface in the Z-axis positive direction). With this, reinforcements 34 improve the stiffness of first support 31 and pedestal 32.

As illustrated in FIG. 1, connector 38 is provided on the Y-axis negative direction side of first support 31, and is a portion to which a line for inputting an audio signal to loudspeaker unit 100 is connected.

Here, the shapes of the plurality of reinforcements 34 viewed from the lateral side (i.e., from a direction orthogonal to the Z-axis direction) are described with reference to FIG. 4 and FIG. 5.

Figure 4:
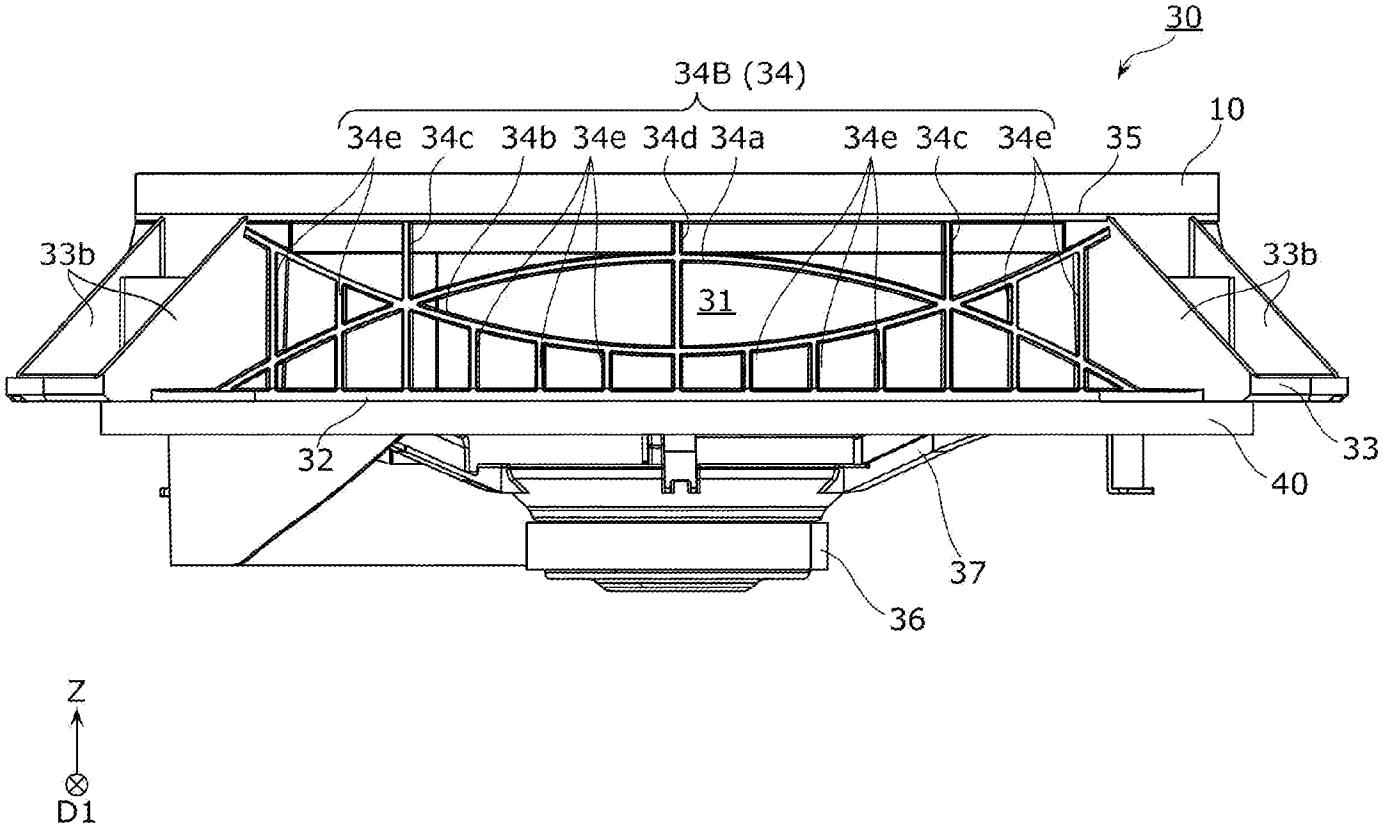
FIG. 4 is a side view of a frame viewed from a first line-of-sight direction in FIG. 3.

FIG. 4 is a side view of the frame viewed from first line-of-sight direction D1 in FIG. 3. FIG. 5 is a side view of the frame viewed from second line-of-sight direction D2 in FIG. 3.

The plurality of reinforcements 34 include first plate portion 34*a* and second plate portion 34*b*. The plurality of reinforcements 34 may further include two third plate portions 34*c*, one fourth plate portion 34*d*, and a plurality of fifth plate portions 34*e*. The plurality of reinforcements 34 are exposed in an outward direction of loudspeaker unit 100. That is to say, frame 30 is a component that does not have a portion covering the outside of the plurality of reinforcements 34.

First plate portion 34*a* is a plate-shaped portion disposed in front of pedestal 32 (in the Z-axis positive direction) to face pedestal 32, and has a bent shape that protrudes in the Z-axis positive direction. The bent shape of first plate portion 34*a* protruding in the Z-axis positive direction is a curved shape. First plate portion 34*a* is disposed across the entire region from, among the plurality of fastening portions 33, one of two fastening portions 33 adjacent in the peripheral direction of the perimeter of first support 31 (hereinafter referred to as "the peripheral direction") to the other of two fastening portions 33. An end of first plate portion 34*a* in the peripheral direction is connected to pedestal 32.

Second plate portion 34*b* is a plate-shaped portion disposed on the Z-axis positive side of pedestal 32 to face pedestal 32 and first plate portion 34*a*, and has a bent shape that protrudes in the rearward direction (the Z-axis negative direction). The bent shape of second plate portion 34*b* protruding on the Z-axis negative side is a curved shape. Second plate portion 34*b* is disposed across the entire region between two fastening portions 33 included in the plurality of fastening portions 33.

First plate portion 34*a* and second plate portion 34*b* intersect one another at two positions. That is to say, the central portion of first plate portion 34*a* in the peripheral direction is located further in the Z-axis positive direction than the central portion of second plate portion 34*b* in the peripheral direction, and both ends of first plate portion 34*a* in the peripheral direction are located further in the Z-axis negative direction than both ends of second plate portion 34*b* in the peripheral direction.

Two third plate portions 34*c* are portions that are oriented to intersect first support 31 and pedestal 32, and that further intersect first plate portion 34*a* and second plate portion 34*b* at the two positions at which first plate portion 34*a* and second plate portion 34*b* intersect. Two third plate portions 34*c* are disposed from pedestal 32 to flange 35.

One fourth plate portion 34*d* is oriented to intersect first support 31 and pedestal 32, and disposed at the substantial center of at least one of first plate portion 34*a* or second plate portion 34*b* in the peripheral direction. Fourth plate portion 34*d* is disposed intersecting first plate portion 34*a* and second plate portion 34*b*. Fourth plate portion 34*d* is disposed from pedestal 32 to flange 35.

The plurality of fifth plate portions 34*e* are oriented to intersect first support 31, pedestal 32, and first plate portion 34*a*, fixed to first support 31, pedestal 32, and first plate portion 34*a*, and lined up in the peripheral direction of the perimeter of first support 31.

Two third plate portions 34*c*, fourth plate portion 34*d*, and the plurality of fifth plate portions 34*e* are portions substantially parallel to first line-of-sight direction D1 and the Z-axis direction. That is to say, two third plate portions 34*c*, fourth plate portion 34*d*, and the plurality of fifth plate portions 34*e* are disposed substantially parallel to one another. Also, two third plate portions 34*c*, fourth plate portion 34*d*, and the plurality of fifth plate portions 34*e* are disposed at substantially equal spaces in a direction substantially orthogonal to first line-of-sight direction D1 and the Z-axis direction.

The plurality of reinforcements 34 may each extend toward the central axis of loudspeaker unit 100 from a substantially central position of reinforcement 34 in the peripheral direction (e.g., first line-of-sight direction D1).

Figure 5:
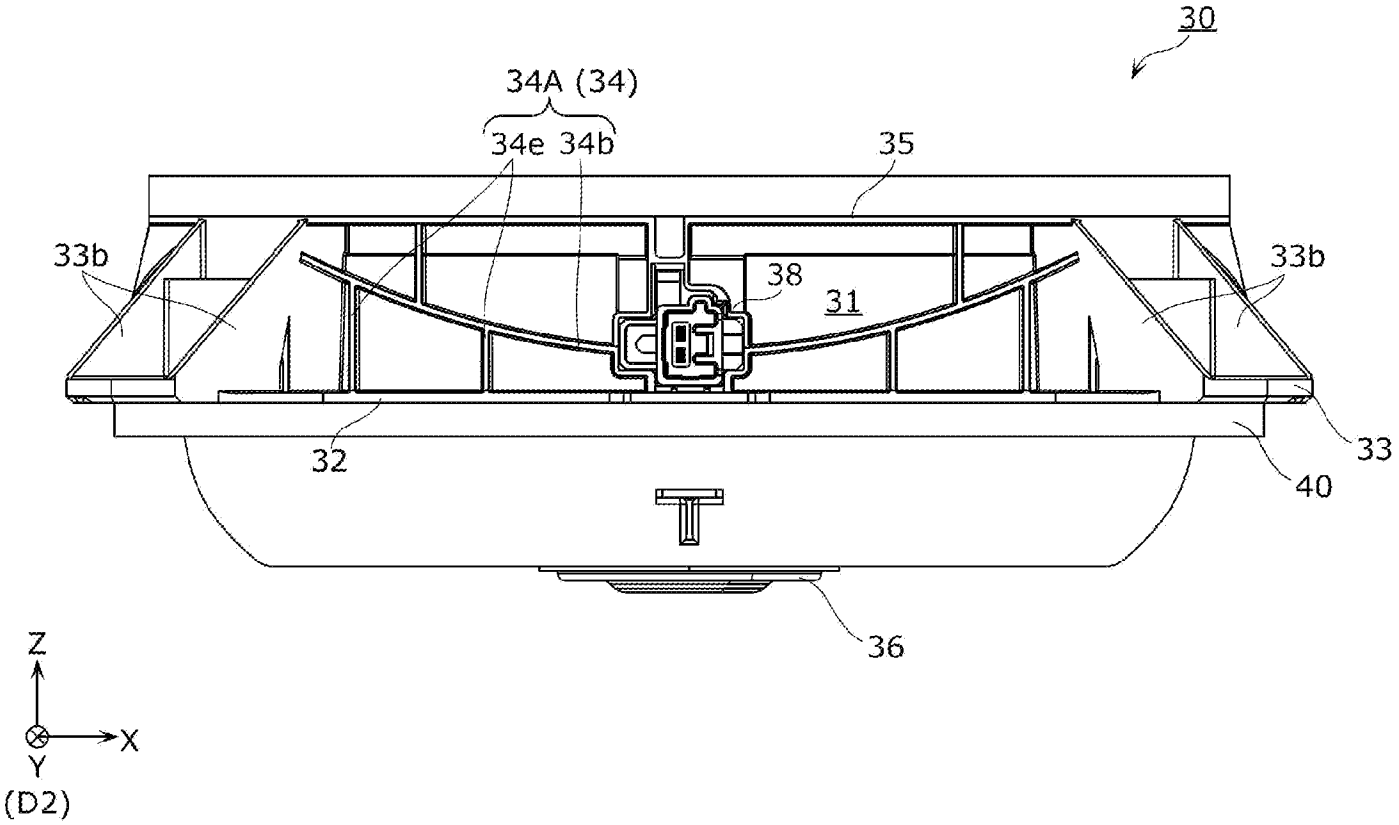
FIG. 5 is a side view of the frame viewed from a second line-of-sight direction in FIG. 3.

As illustrated in FIG. 3 through FIG. 5, among the plurality of reinforcements 34, first reinforcement 34A in which connector 38 is disposed is different in configuration from second reinforcements 34B in which connector 38 is not disposed.

Specifically, among the plurality of reinforcements 34, first reinforcement 34A provided between first fastening portion 33A and second fastening portion 33B need not include first plate portion 34*a* having a bent shape that protrudes in the Z-axis positive direction. The total number of plate portions included in first reinforcement 34A and substantially parallel to second line-of-sight direction D2 and the Z-axis direction may be less than the total number of plate portions included in second reinforcement 34B and substantially parallel to first line-of-sight direction D1 and the Z-axis direction. Since the total number of plate portions included in first reinforcement 34A is less than the total number of plate portions included in second reinforcement 34B as described above, first reinforcement 34A is less stiff than second reinforcement 34B. This is for the adjustment made so that the combined stiffness of first reinforcement 34A and connector 38 becomes equal to the stiffness of second reinforcement 34B, because connector 38 is disposed in first reinforcement 34A. In other words, the stiffnesses of the plurality of regions of pedestal 32 between the plurality of fastening portions 33 are substantially equal.

Loudspeaker unit 100 according to the present embodiment includes frame 30 that supports diaphragm 21 and magnetic circuit 22 to allow emission of a sound in the Z-axis positive direction. Frame 30 includes first support 31, pedestal 32, a plurality of fastening portions 33, and a plurality of reinforcements 34. First support 31 supports the perimeter of diaphragm 21. Pedestal 32 extends outwardly from the perimeter of first support 31. The plurality of fastening portions 33 are provided in a plurality of positions on pedestal 32 that surround the perimeter of first support 31. The plurality of reinforcements 34 are disposed in a plurality of regions of pedestal 32 between the plurality of fastening portions 33, and fixed to first support 31 and pedestal 32. The plurality of reinforcements 34 include first plate portion 34*a* and second plate portion 34*b*. First plate portion 34*a* is a plate-shaped portion disposed in the Z-axis positive direction of pedestal 32 to face pedestal 32, and has a bent shape that protrudes in the Z-axis positive direction. Second plate portion 34*b* is a plate-shaped portion disposed in the Z-axis positive direction of pedestal 32 to face pedestal 32 and first plate portion 34*a*, and has a bent shape that protrudes in the Z-axis negative direction.

According to this, the plurality of reinforcements 34 include first plate portion 34*a* which is a plate-shaped portion having a bent shape that protrudes in the Z-axis positive direction and second plate portion 34*b* which is a plate-shaped portion having a bent shape that protrudes in the Z-axis negative direction, and thus, it is possible to effectively improve the stiffness of the plurality of regions of frame 30 between the plurality of fastening portions 33. This makes it possible to ensure the stiffness necessary for frame 30, even when the weight of frame 30 is sufficiently reduced. Accordingly, it is possible to sufficiently reduce the weight of loudspeaker unit 100 while ensuring the stiffness of frame 30.

Generally, air tightness and water tightness are improved by disposing second elastic component 40 between pedestal 32 of loudspeaker unit 100 and opening portion 111 as a gasket. In addition, loudspeaker unit 100 is fastened to opening portion 111 by a fastener to exert a compressive stress at the plurality of fastening portions 33 of frame 30, with second elastic component 40 disposed between pedestal 32 and opening portion 111. Therefore, pedestal 32 of frame 30 is subjected to a repulsive force from second elastic component 40. In particular, regions of pedestal 32 between the plurality of fastening portions 33 are not fastened with a fastener, and are thus susceptible to deformation into a bent shape protruding toward the side opposite opening portion 111. Since the plurality of reinforcements 34 improve the stiffness of first support 31 and pedestal 32, it is possible to inhibit portions of first support 31 and pedestal 32 between the plurality of fastening portions 33 from deforming into a bent shape protruding toward the side opposite opening portion 111. In such a manner, since first support 31 and pedestal 32 can be inhibited from deformation, it is possible to inhibit generation of a gap between pedestal 32 and opening portion 111. Accordingly, it is possible to improve the air tightness and the water tightness between loudspeaker unit 100 and opening portion 111.

In the present embodiment, the plurality of reinforcements 34 are exposed in the outward direction of loudspeaker unit 100. Thus, the stiffness of frame 30 can be improved without complicating the shape of frame 30.

In the present embodiment, the bent shape of at least one of first plate portion 34*a* or second plate portion 34*b* included in the plurality of reinforcements 34 is a curved shape. Thus, the stiffness of the plurality of reinforcements 34 can be improved effectively.

In the present embodiment, at least one of first plate portion 34*a* or second plate portion 34*b* included in the plurality of reinforcements 34 is disposed across an entire region between two adjacent fastening portions 33 included in the plurality of fastening portions 33. Thus, it is possible to effectively improve the stiffness of frame 30 in the entire region between two adjacent fastening portions 33.

In the present embodiment, an end of first plate portion 34*a* included in the plurality of reinforcements 34 in a peripheral direction of the perimeter of first support 31 is connected to pedestal 32. Thus, the stiffness of the plurality of reinforcements 34 can be improved effectively.

In the present embodiment, first plate portion 34*a* and second plate portion 34*b* intersect one another at two positions. Thus, it is possible to increase the lengths of the portions of first plate portion 34*a* and second plate portion 34*b* that are fixed to first support 31. Accordingly, the stiffness of first support 31 can be improved effectively.

In the present embodiment, the plurality of reinforcements 34 include: two third plate portions 34*c* that are oriented to intersect first support 31 and pedestal 32, and that further intersect first plate portion 34*a* and second plate portion 34*b* at the two positions at which first plate portion 34*a* and second plate portion 34*b* intersect. Thus, the stiffness of first support 31 and pedestal 32 can be improved effectively.

In the present embodiment, the plurality of reinforcements 34 further include: fourth plate portion 34*d* oriented to intersect first support 31 and pedestal 32, and disposed at the substantial center of at least one of first plate portion 34*a* or second plate portion 34*b* in the peripheral direction of the perimeter of first support 31. Thus, the stiffness of first support 31 and pedestal 32 can be improved effectively.

In the present embodiment, the plurality of reinforcements 34 each extend toward the central axis of loudspeaker unit 100 from a substantially central position of reinforcement 34.

Thus, for example, when molding frame 30 with resin, it is sufficient so long as a die is used which has a shape substantially parallel to the direction toward the central axis of loudspeaker unit 100 from the substantially central position of reinforcement 34.

In the present embodiment, frame 30 further includes connector 38 which is provided between first fastening portion 33A and second fastening portion 33B included in the plurality of fastening portions 33 and to which a line for inputting an audio signal to loudspeaker unit 100 is connected. Among the plurality of reinforcements 34, first reinforcement 34A provided between first fastening portion 33A and second fastening portion 33B is less stiff than second reinforcement 34B different from first reinforcement 34A.

The region of pedestal 32 where connector 38 is provided has increased stiffness since connector 38 is formed. By making first reinforcement 34A less stiff than second reinforcement 34B, it is possible to even out the stiffnesses of a plurality of regions of pedestal 32. This makes it possible to inhibit deformation and/or breakage of a particular portion of pedestal 32 as a result of a load imposed only on the particular portion.

Variations of Embodiment 1

[2-1. Variation 1]

In the above embodiment, the bent shape of first plate portion 34*a* protruding in the Z-axis positive direction and the bent shape of second plate portion 34*b* protruding in the Z-axis negative direction are curved shapes; however, these bent shapes are not limited to curved shapes. For example, the bent shape of first plate portion 34*a* protruding in the Z-axis positive direction and the bent shape of second plate portion 34*b* protruding in the Z-axis negative direction may be angular shapes. In other words, in this case, the bent shape of first plate portion 34*a* protruding in the Z-axis positive direction is, for example, a shape obtained by butting two flat plate portions against one another to make an angle in the Z-axis positive direction. Likewise, the bent shape of second plate portion 34*b* protruding in the Z-axis negative direction is, for example, a shape obtained by butting two flat plate portions against one another to make an angle in the Z-axis negative direction.

[2-2. Variation 2]

In the above embodiment, for each of the plurality of regions between the plurality of fastening portions 33, reinforcement 34 is formed across the entire region in the peripheral direction of the region; however, the reinforcement need not be formed across the full width of each region. For example, a reinforcement may be configured such that both ends of the reinforcement are not fixed to the fastening portions.

[2-3. Variation 3]

In the above embodiment, first plate portion 34*a* is not connected to flange 35; however, the configuration is not limited to this, and a portion of first plate portion 34*a* (for example, a portion in the vicinity of the substantial center of first plate portion 34*a* in the peripheral direction) may be connected to flange 35.

Likewise, in the above embodiment, second plate portion 34*b* is not connected to flange 35; however, both ends of second plate portion 34*b* in the peripheral direction may be connected to flange 35.

[2-4. Variation 4]

In the above embodiment, second plate portion 34*b* is not connected to pedestal 32; however, the configuration is not limited to this, and a portion of second plate portion 34*b* (for example, a portion in the vicinity of the substantial center of second plate portion 34*b* in the peripheral direction) may be connected to pedestal 32.

Embodiment 2

Figure 6:
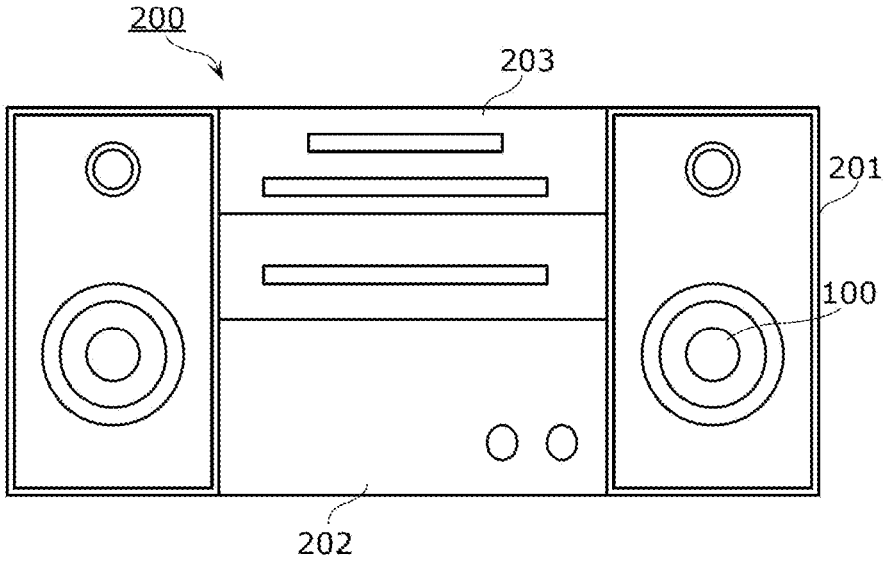
FIG. 6 is an external view of an audio mini-component system which is an electronic device according to Embodiment 2.

Next, the following describes an example of an electronic device including loudspeaker unit 100 with reference to FIG. 6. FIG. 6 is an external view of a mini-component system for audio which is the electronic device according to Embodiment 2.

A loudspeaker system is configured by incorporating loudspeaker unit 100 into enclosure 201. Mini-component system 200 includes the loudspeaker system, amplifier 202 which is an amplifier that amplifies an electric signal to be input to loudspeaker unit 100, and player 203 which outputs a source to be input to amplifier 202. That is to say, mini-component system 200 includes loudspeaker unit 100 and amplifier 202 which is a circuit that inputs an electric signal to loudspeaker unit 100.

This configuration can realize an electronic device capable of contributing to addressing global environmental issues through weight reduction and resource saving.

Furthermore, since the strength of the frame is ensured, deformation that occurs at the time of affixation, affixation distortion, or the like can be significantly reduced, thus realizing an electronic device capable of achieving low price, high quality, and high reliability. Thus, it is possible to yield a remarkable advantageous effect of weight reduction, resource saving, low price, high quality, and high reliability of the electronic device.

Embodiment 3

Figure 7:
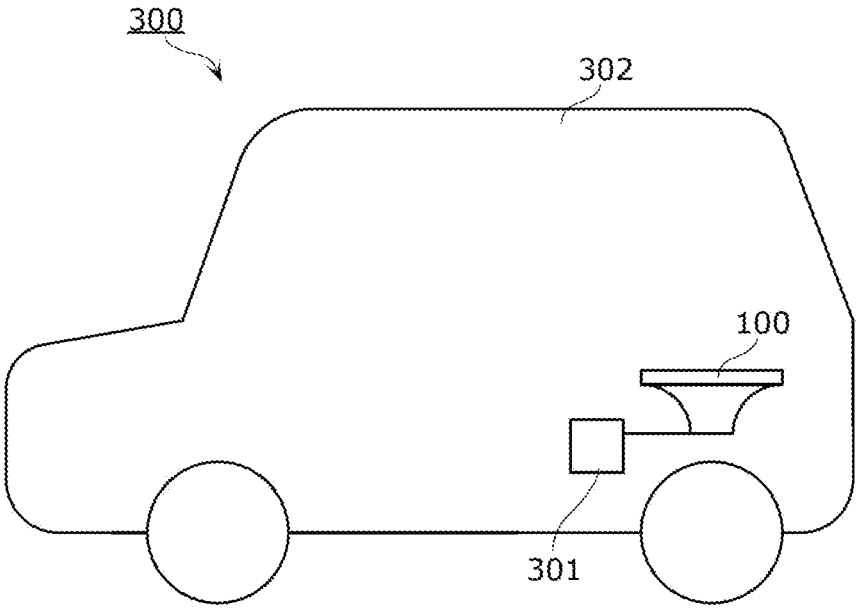
FIG. 7 is a cross sectional view of an automobile which is a mobile body apparatus according to Embodiment 3.

Next, the following describes an example of a mobile body apparatus including loudspeaker unit 100 with reference to FIG. 7. FIG. 7 is a cross sectional view of an automobile which is the mobile body apparatus according to Embodiment 3.

Automobile 300 is configured by incorporating loudspeaker unit 100 into a rear tray and/or a front panel for use as a part of a car navigation system and/or a car audio system. The car navigation system and the car audio system include circuit 301 that inputs an electric signal to a loudspeaker. That is to say, automobile 300, which is a mobile body apparatus, includes loudspeaker unit 100, circuit 301 that inputs an electric signal to loudspeaker unit 100, and main body 302 which moves by itself and to which loudspeaker unit 100 and circuit 301 are provided.

A position in automobile 300 at which loudspeaker unit 100 is affixed is not necessarily limited to a rear tray or a front panel; loudspeaker unit 100 may be affixed at any position including a door, a ceiling, a pillar portion, an instrument panel part, a floor, or the like.

This configuration can achieve low fuel consumption of the mobile body apparatus through weight reduction and resource saving, thus realizing a mobile body apparatus capable of contributing to addressing global environmental issues. Furthermore, since the strength of the frame is ensured, deformation that occurs at the time of affixation, affixation distortion, or the like can be significantly reduced, thus realizing a mobile body apparatus capable of achieving low price, high quality, and high reliability. Thus, it is possible to yield a remarkable advantageous effect of weight reduction, resource saving, low price, high quality, and high reliability of the mobile body apparatus.

Although a loudspeaker unit according to one or more aspects of the present disclosure has been described above based on Embodiments 1 through 3, the present disclosure is not limited to Embodiments 1 through 3. The scope of one or more aspects of the present disclosure may also encompass other forms achieved by making various modifications conceivable by a person of skill in the art to Embodiments 1 through 3, as well as other forms achieved by combining the elements in Embodiments 1 through 3, so long as such forms are within the essence of the present disclosure.

While various embodiments have been described herein above, it is to be appreciated that various changes in form and detail may be made without departing from the spirit and scope of the present disclosure as presently or hereafter claimed.

Further Information about Technical Background to this Application

The disclosures of the following patent applications including specification, drawings and claims are incorporated herein by reference in their entirety: Japanese Patent Application No. 2019-080410 filed on Apr. 19, 2019 and PCT International Application No. PCT/JP2020/016276 filed on Apr. 13, 2020.

INDUSTRIAL APPLICABILITY

The present disclosure is useful for a loudspeaker unit and the like which can achieve sufficient weight reduction.

The invention claimed is:

1. A loudspeaker, comprising:

a frame that supports a diaphragm and a magnetic circuit to allow emission of a sound in a forward direction, wherein the frame includes a support supporting a perimeter of the diaphragm;

a pedestal extending outwardly from a perimeter of the support;

a plurality of fastening portions provided in a plurality of positions on the pedestal that surround the perimeter of the support; and a plurality of reinforcements disposed in a plurality of regions of the pedestal between the plurality of fastening portions, and fixed to the support and the pedestal, wherein the plurality of reinforcements include a first plate portion that is a plate-shaped portion disposed in front of the pedestal to face the pedestal, and has a bent shape that protrudes in the forward direction; and a second plate portion that is a plate-shaped portion disposed in front of the pedestal to face the pedestal and the first plate portion, and has a bent shape that protrudes in a rearward direction, and the first plate portion and the second plate portion intersect one another at two positions, and wherein the plurality of reinforcements further include two third plate portions that are oriented to intersect the support and the pedestal, and that further intersect the first plate portion and the second plate portion at the two positions at which the first plate portion and the second plate portion intersect.

2. The loudspeaker according to claim 1, wherein the plurality of reinforcements are exposed in an outward direction of the loudspeaker.

3. The loudspeaker according to claim 1, wherein the bent shape of at least one of the first plate portion or the second plate portion included in the plurality of reinforcements is a curved shape.

4. The loudspeaker according to claim 1, wherein the bent shape of at least one of the first plate portion or the second plate portion included in the plurality of reinforcements is an angular shape.

5. The loudspeaker according to claim 1, wherein at least one of the first plate portion or the second plate portion included in the plurality of reinforcements is disposed across an entire region between two adjacent fastening portions included in the plurality of fastening portions.

6. The loudspeaker according to claim 1, wherein an end of the first plate portion included in the plurality of reinforcements in a peripheral direction of the perimeter of the support is connected to the pedestal.

7. The loudspeaker according to claim 1, wherein the plurality of reinforcements further include a fourth plate portion oriented to intersect the support and the pedestal, and disposed at a substantial center of at least one of the first plate portion or the second plate portion in a peripheral direction of the perimeter of the support.

8. The loudspeaker according to claim 1, wherein the support includes a flange that is disposed in front of the first plate portion to face the first plate portion, and extends outwardly from the perimeter of the support, and a portion of the first plate portion is connected to the flange.

9. The loudspeaker according to claim 1, wherein a portion of the second plate portion is connected to the pedestal.

10. An electronic device, comprising:

the loudspeaker according to claim 1; and a circuit that inputs an electric signal to the loudspeaker.

11. A mobile body apparatus, comprising:

the loudspeaker according to claim 1;

a circuit that inputs an electric signal to the loudspeaker; and a main body which moves by itself and to which the loudspeaker and the circuit are provided.

* * * * *